US007520199B2

(12) United States Patent
Stawarski

(10) Patent No.: US 7,520,199 B2
(45) Date of Patent: Apr. 21, 2009

(54) INDEXABLE PRY TOOL AND SPLINED COUPLING ARRANGEMENT THEREFOR

(75) Inventor: Rafal P. Stawarski, Roselle, IL (US)

(73) Assignee: AJ Manufacturing Co., Inc., Elmhurst, IL (US)

( * ) Notice: Subject to any disclaimer, the term of this patent is extended or adjusted under 35 U.S.C. 154(b) by 0 days.

(21) Appl. No.: 12/117,067

(22) Filed: May 8, 2008

(65) Prior Publication Data

US 2008/0282845 A1 Nov. 20, 2008

Related U.S. Application Data

(60) Provisional application No. 60/938,759, filed on May 18, 2007.

(51) Int. Cl.
*B25B 23/16* (2006.01)

(52) U.S. Cl. ..... 81/177.8; 81/177.7; 81/58.3

(58) Field of Classification Search ..... 81/177.7–117.9, 81/58.3; 254/21, 25, 129, 131, 26 R; 403/97, 403/103, 107, 359.1, 359.3; 192/69, 69.91
See application file for complete search history.

(56) References Cited

U.S. PATENT DOCUMENTS

| | | | | | |
|---|---|---|---|---|---|
| 746,083 | A * | 12/1903 | Holbrook | 254/25 |
| 2,921,773 | A * | 1/1960 | Hoelzer | 254/129 |
| 5,123,768 | A * | 6/1992 | Franklin | 403/96 |
| 5,280,738 | A * | 1/1994 | Liou | 81/20 |
| 6,840,141 | B2 * | 1/2005 | Cole | 81/177.8 |
| 7,246,545 | B1 * | 7/2007 | Lee | 81/177.9 |
| 7,278,626 | B1 * | 10/2007 | Chang | 254/25 |
| 7,302,876 | B1 * | 12/2007 | Lee | 81/177.9 |

(Continued)

FOREIGN PATENT DOCUMENTS

| | | |
|---|---|---|
| DE | 20 2004 009880 | 9/2004 |

(Continued)

OTHER PUBLICATIONS

International Search Report dated Aug. 11, 2008.

*Primary Examiner*—D. S Meislin
(74) *Attorney, Agent, or Firm*—Andrus, Sceales, Starke & Sawall, LLP

(57) ABSTRACT

An indexable tool includes a handle having a first prong formed with a first splined orifice and a second prong formed with a second splined orifice. An indexable body has a third splined orifice aligned with the first and second splined orifices. A splined coupling arrangement rotatably joins and selectively locks and unlocks the handle and the indexable body together. The coupling arrangement includes a push button, first and second adjacently disposed inserts, a retainer, a cap and a spring. In a locked position, the spring is biased to hold external splines of the first and second serrated inserts in common engagement with the first, second and third splined orifices to prevent relative rotation between the indexable body and the handle. In an unlocked position, the push button is pushed against the bias of the spring to move external splines of the first serrated insert into exclusive engagement with the third splined orifice of the indexable body, and to move the external splines of the second serrated insert into engagement with the splined orifice of the second prong enabling rotary adjustment of the indexable body relative to the handle and about the cylinder.

11 Claims, 5 Drawing Sheets

U.S. PATENT DOCUMENTS

| | | | | |
|---|---|---|---|---|
| 7,415,911 | B2 * | 8/2008 | Cole et al. | 81/177.8 |
| 2004/0134314 | A1 | 7/2004 | Cole | |
| 2006/0236821 | A1 * | 10/2006 | Liao | 81/124.4 |
| 2006/0260445 | A1 * | 11/2006 | Cole | 81/177.8 |
| 2007/0034058 | A1 * | 2/2007 | Chen | 81/58 |

FOREIGN PATENT DOCUMENTS

| | | |
|---|---|---|
| EP | 1 657 457 | 5/2006 |

* cited by examiner

TOOL IN LOCKED POSITION

TOOL IN UNLOCKED POSITION

INDEXABLE PRY TOOL AND SPLINED COUPLING ARRANGEMENT THEREFOR

CROSS-REFERENCE TO RELATED APPLICATIONS

This application relates to and claims priority from U.S. Provisional Patent Application Ser. No. 60/938,759 filed May 18, 2007.

FIELD OF THE INVENTION

The present invention relates generally to hand tools and, more particularly, pertains to hand tools having operating components rotatably joined together for relative movement by a coupling arrangement.

BACKGROUND OF THE INVENTION

Devices for coupling two members together are well known. One existing device includes a radial indexing head and ratchet head, each with a splined orifice and a floating splined pin disposed in the splined orifice for coupling them together. The floating splined pin has an axial retainer coupled to the handle and extending into the splined orifices, a plunger configured for floating axial movement within the retainer and a splined cylinder configured for axial movement along the outside of the axial retainer within the splined orifices. The plunger and the splined cylinder are directly coupled to each other through the cylinder wall of the retainer. A retaining pin is inserted through a splined cylinder aperture, a retainer slot and a plunger aperture. Movement of the splined cylinder aligns or misaligns grooves and splined portions formed on the splined cylinder relative to like parts in the splined orifices to lock or unlock the ratchet head for movement relative to the handle.

Despite the prior art, there remains a need to provide a first tool component which is selectively locked and unlocked in various rotary positions relative to a second tool component in a manner which will be simpler in structure and more reliable in operation.

SUMMARY OF THE INVENTION

This invention relates to an indexable tool including a handle having a first prong formed with a first splined surface and a second prong formed with a second splined orifice. An indexable body has a third splined orifice aligned with the first and second splined orifices. A splined coupling arrangement rotatably joins and selectively locks and unlocks the handle and the indexable body together. The coupling arrangement includes a push button disposed within the first, second and third orifices for slidable movement relative thereto. A first serrated insert is positioned on the push button, and a second serrated insert is positioned on the push button and engagable against the first serrated insert. The first and second serrated inserts have external splines variously engaged with the first, second and third splined orifices upon slidable movement of the push button. A retainer is disposed within the second and third splined orifices for slidable movement relative thereto. The retainer is constantly engaged with the second serrated insert and is fixedly coupled to the push button by a fastener threaded axially thereof. A cap is screw threaded into the second prong, and a spring is interposed between the cap and the fastener.

In a locked position, the spring is biased to hold the external splines of the first and second serrated inserts into common engagement with the first, second and third splined orifices to prevent relative rotation between the indexable body and the handle. In an unlocked position, the push button is pushed against the bias of the spring to move the external splines of the first serrated insert into exclusive engagement with the third splined orifice of the indexable body, and to move the external splines of the second serrated insert into engagement with the splined orifice of the second prong enabling rotary adjustment of the indexable body relative to the handle and about the cylinder.

BRIEF DESCRIPTION OF THE DRAWINGS

The drawings illustrate the best mode presently contemplated of carrying out the invention. In the drawings.

DETAILED DESCRIPTION

Figure 1:
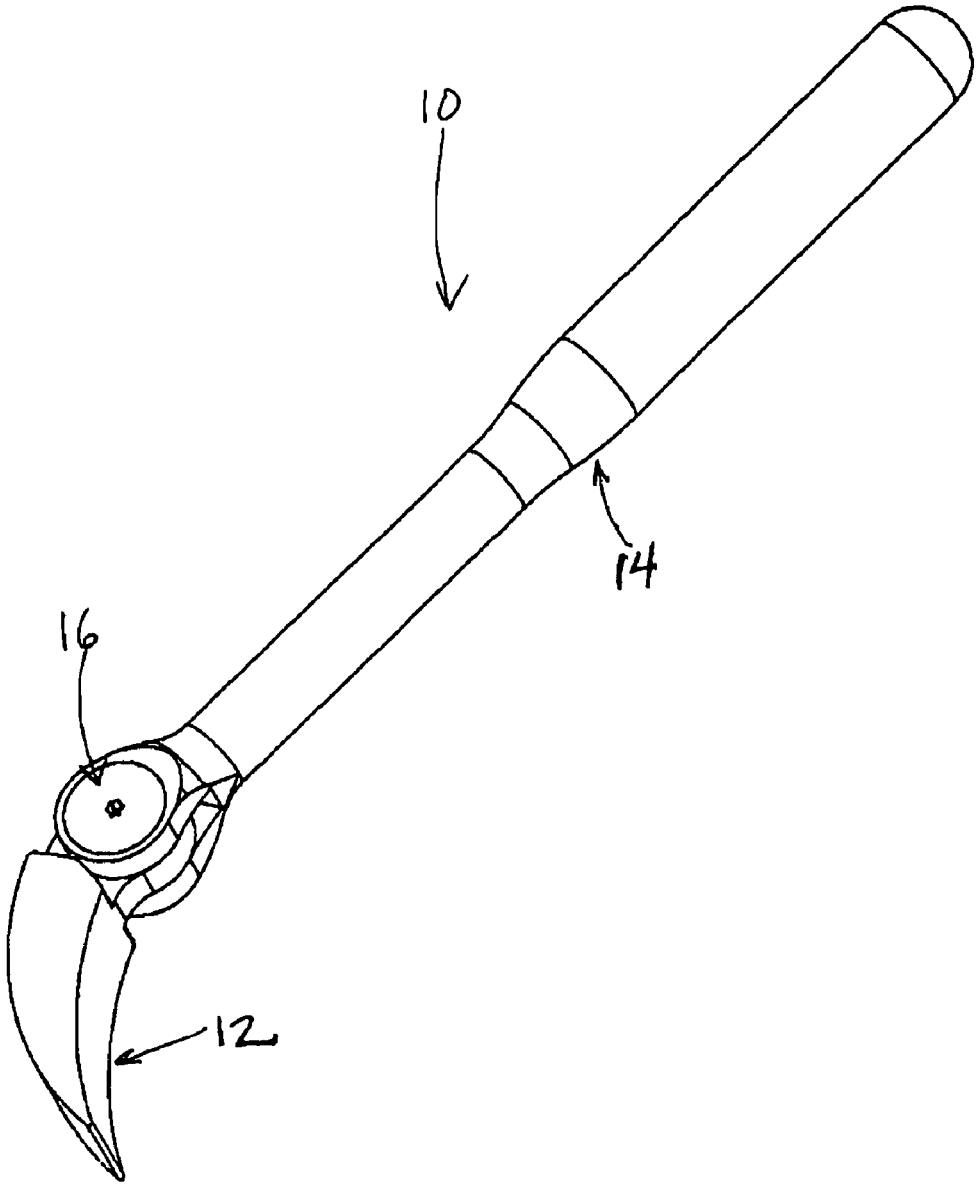
FIG. 1 is a perspective view of an indexable pry tool in accordance with the present invention.
Figure 2:
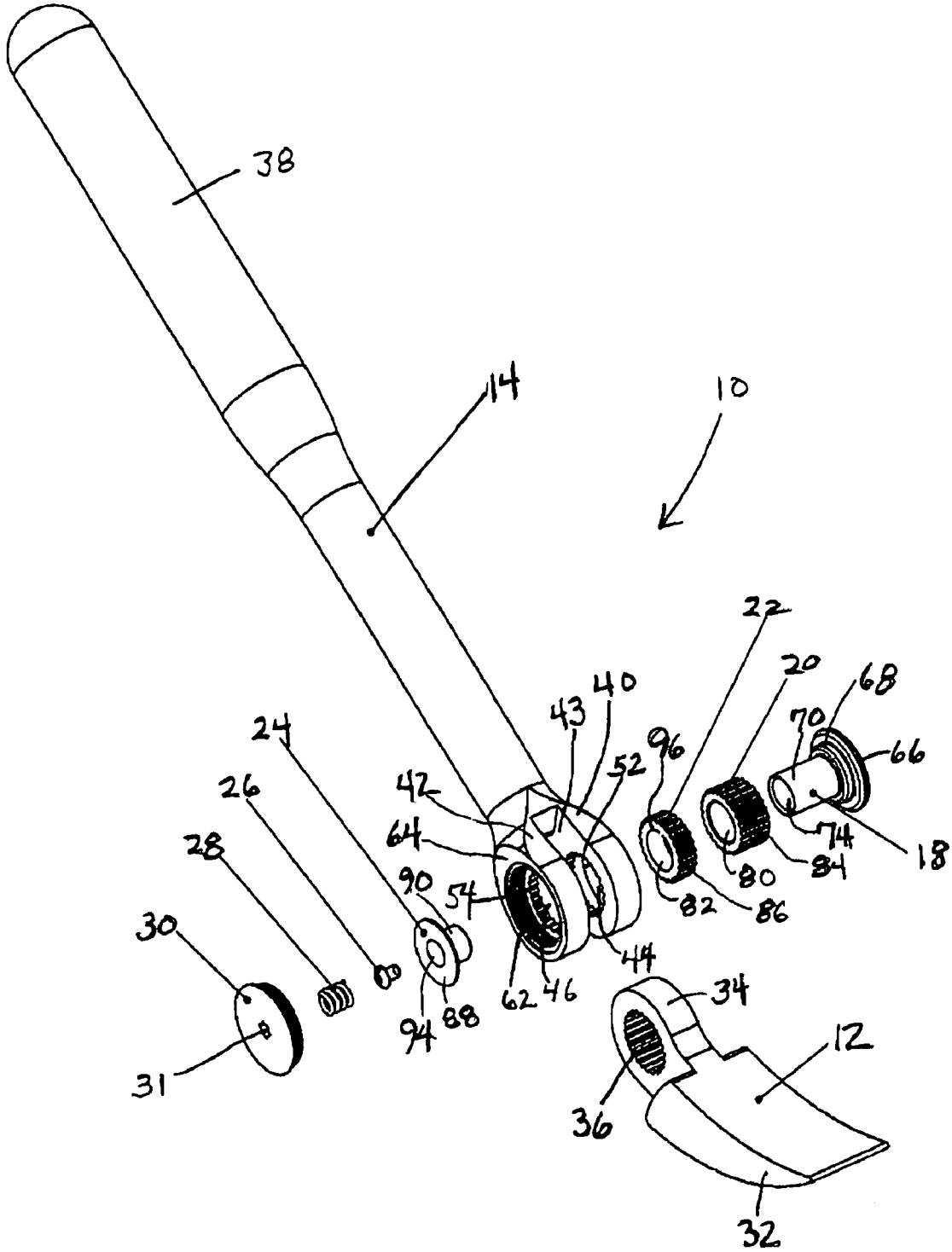
FIG. 2 is an exploded view of the indexable pry tool.
Figure 3:
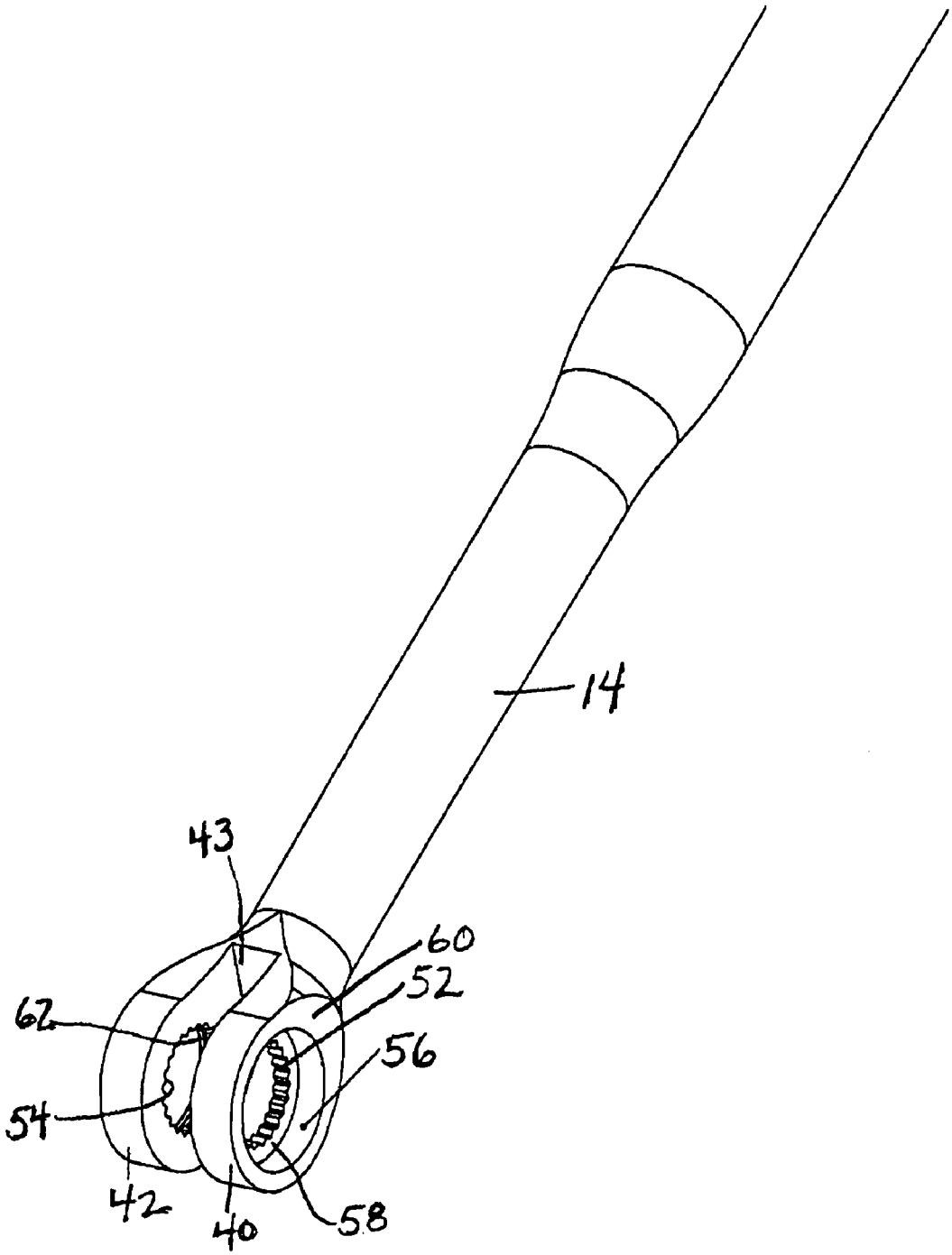
FIG. 3 is a partial perspective view of a portion of the handle of the indexable pry tool.

Referring now to the drawings, thereshown is an indexable pry tool 10 embodying the present invention. The pry tool 10 includes an indexable body 12 adjustably joined to an elongated handle 14. The indexable body 12 and the handle 14 are selectively locked and unlocked relative to each other in a number of rotational positions by a splined coupling arrangement 16 comprised of a push button 18, a first serrated insert 20, a second serrated insert 22, a retainer 24, a fastener 26, a coil spring 28 and a cap 30.

The indexable body 12 is preferably shown as a curved pry bar 32 provided with an attaching member 34 having a splined orifice 36. It should be understood, however, that the indexable body 12 may take other forms. The handle 14 is configured with a gripping portion 38 at an upper end, and a pair of bifurcated first and second prongs 40, 42 at a lower end. The prongs 40, 42 are spaced apart by a slot 43 for receiving the attaching member 34 of the indexable body 12. The prongs 40, 42 are commonly provided with throughholes 44, 46 that are aligned with the splined orifice 36 of the indexable body 12. The prongs 40, 42 are formed with radially projecting annular shoulders 48, 50 having splined peripheral surfaces 52, 54, respectively, aligned with the splined orifice 36 of indexable body 12. First prong 40 has a counterbore defined by a smooth annular wall 56 for slidably receiving an upper portion of the push button 18. Annular wall 56 extends axially outward from a sidewall 58 of shoulder 48 to an outer base 60 of first prong 40. Second prong 42 has a counterbore defined by a threaded annular surface 62 that threadably receives the cap 30. Cap 30 is provided with a tool-receiving recess 31 for facilitating insertion and removal in prong 42. Threaded annular surface 62 extends axially outward from sidewall 63 of shoulder 50 and terminates inwardly of an outer face 64 of second prong 42.

The push button 18 includes a circular planar head 66, a step-down neck 68 underlying the head 66 and a cylinder 70 depending from the neck 68. The push button 18 is internally formed with a guide 71 having a threaded hole 72 that extends longitudinally through the center of cylinder 70 and opens into a bore 74 formed in the lower portion thereof. Bore 74 is defined by a cylindrical sidewall 76 and an upper wall 78.

Figure 4:
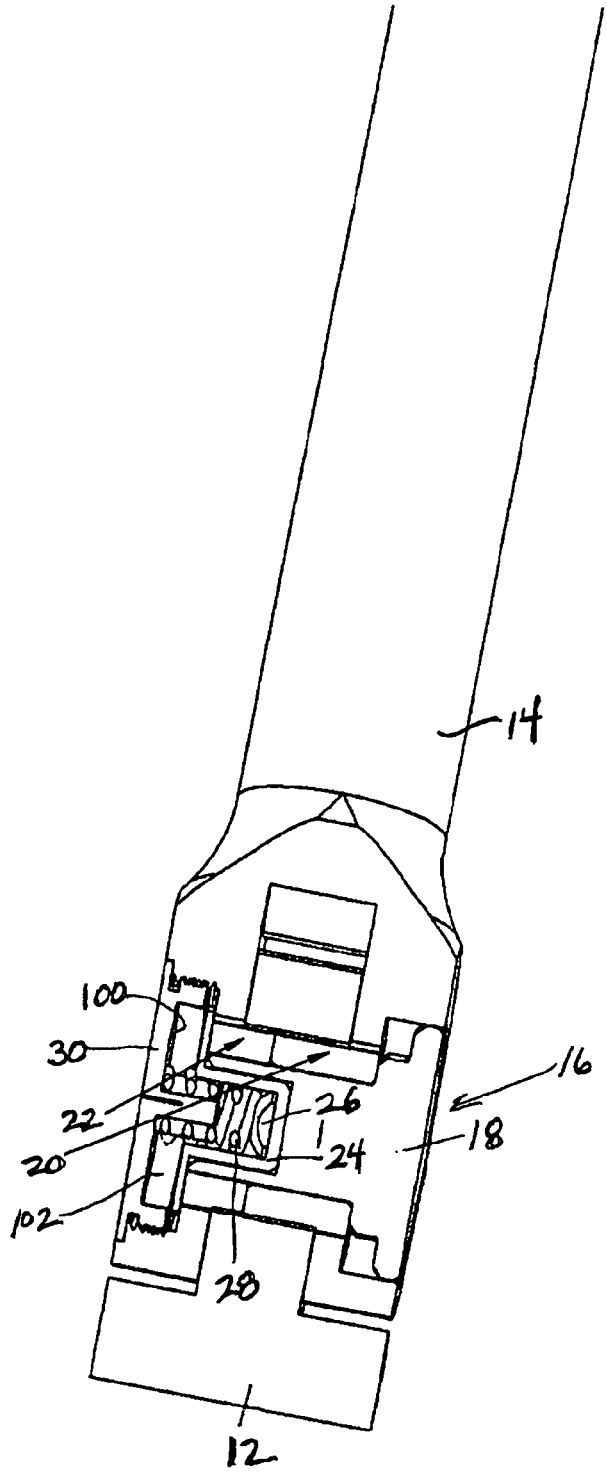
FIG. 4 is a partial sectional view of the indexable pry tool in a locked position.
Figure 5:
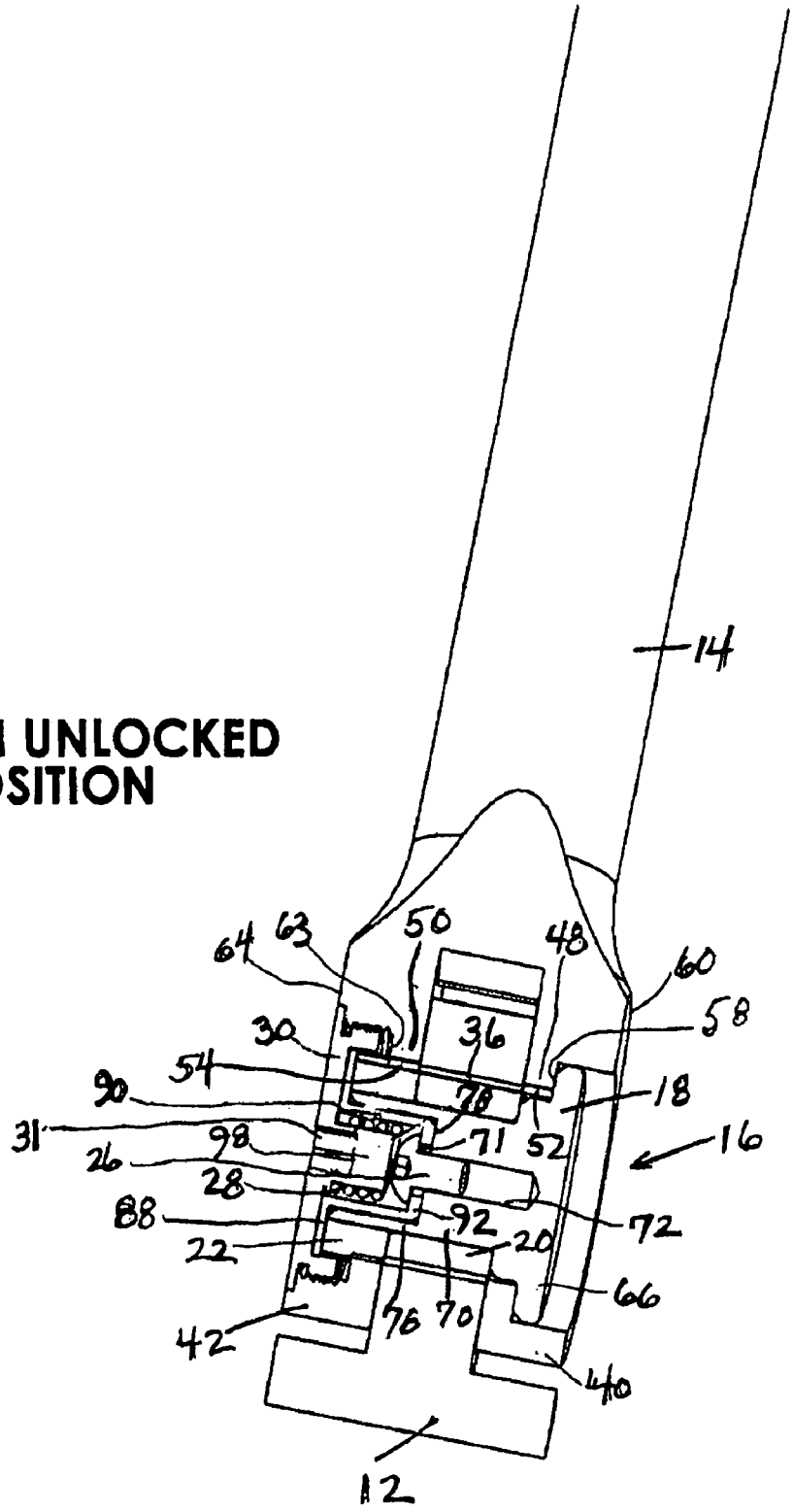
FIG. 5 is a partial sectional view of the indexable pry tool in an unlocked position.

The first and second serrated inserts 20, 22 form a splined cylinder arrangement and are substantially identical except that the height of the first serrated insert 20 is higher than that of the second serrated insert 22. The first and second serrated inserts 20, 22 have central longitudinal bores 80, 82, respectively, that are sized to slidably accommodate the push button cylinder 70 along substantially the entire length thereof when the inserts 20, 22 are aligned together as shown in FIGS. 4 and 5. The first and second inserts 20, 22 are provided with longitudinally extending external splines 84, 86, respectively, that form a continuous splined formation along the combined length of the adjacently disposed inserts 20, 22. The external splines 84, 86 are aligned with each other and variously engaged with the splined orifice 36 of indexable body 12 and the splined peripheral surfaces 52, 54 of the prongs 40, 42. It should be understood that the inserts 20, 22 may be of equal height, may have different relative heights or sizes, and that there may be a different number of inserts.

The retainer 24 has a circular planar flange 88 and a cylinder 90 having a bottom wall 92 that sits on guide 71 for receiving the fastener 26. A central bore 94 is formed in the flange 88 and the cylinder 90 and is in communication with the hole 72. The retainer cylinder 90 fits within the bore 74 of the push button 18 such that the retainer bottom wall 92 abuts the push button upper wall 78, and the retainer flange 88 overlies the end of the push button cylinder 70 and an end surface 96 of the second serrated insert 22.

With splined orifice 36 of body attaching member 34 aligned with respective splined surfaces 52, 54 of prongs 40, 42, the inserts 20, 22 are slidably disposed on push button cylinder 70 and passed through prong 40. Retainer 24 is inserted through prong 42 until retainer bottom wall 92 engages push button upper wall 78, and retainer flange 88 overlies the end of push button cylinder 70 and end surface 96 of the insert 22. Fastener 26 is placed through retainer bore 94 and threaded into hole 72 to hold push button 18, inserts 20, 22 and retainer 24 together. Spring 28 is then inserted into retainer bore 94 and cap 30 is screw threaded into threaded annular surface 62 in prong 42 such that the spring 28 surrounds a guide 98 depending from the cap 30. Spring 28 has one end biased against an underside 100 of cap 30 and an opposite end biased against the head of screw 26.

In the locked position shown in FIG. 4, the spring 28 biases the push button head 66 to the outer face 60 of prong 40. This places the respective splines 84, 86 of the inserts 20, 22 in interlocking engagement with the splined orifice 36 of body 12 and the splined peripheral surfaces 52, 54 of the prongs 40, 42. As a result, the indexable body 12 is unable to rotate relative to the prongs 40, 42 and is held locked in one rotary position.

In the unlocked position shown in FIG. 5, manual pressure is applied to the push button head 66 against the bias of spring 28. This results in forcing retainer flange 88 through a recess 102 in cap 30 and against the underside 100 thereof. At the same time, the splines 86 of insert 22 are slidably engaged with the splined peripheral surface 54 of prong 42, and the splines 84 of insert 20 are exclusively slidably engaged with the splined orifice 36 of indexable body 12. As a result, the indexable body 12 and the insert 20 will freely rotate relative to handle 14 about the smooth outer surface of the push button cylinder 70 to a desired rotational setting. Releasing pressure on the push button 18 will return the tool 10 to the lock position of FIG. 4.

In the splined coupling arrangement 16, the push button 18, the inserts 20, 22 and the retainer 24 are constantly coupled axially together by the fastener 26. The components of the arrangement 16 are suitably sized and shaped so that the axial travel of the retainer flange 88 through cap recess 102 and the travel of push button head 66 through counterbore 56 will allow the insert 20 to be selectively moved into and out of sole alignment with splined orifice 36 of the body 12.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. An indexable tool comprising:

a handle;

an indexable body rotationally coupled to the handle; and a splined coupling arrangement for coupling the handle to the body, the splined coupling arrangement comprising a push button, a splined cylinder arrangement mounted on the push button, a retainer received within the push button and a fastener passed through a longitudinal bore of the retainer and threaded into a longitudinal hole formed in the push button for fixedly coupling and preventing relative sliding movement of the push button, the splined cylinder arrangement and the retainer, wherein a series of splines on the splined cylinder arrangement engage the handle and the body when the splined cylinder arrangement is in a locked position thereby keeping the handle fixed relative to the body, and wherein displacement of the push button causes displacement of the splined cylinder arrangement into an unlocked position that causes a series of splines to disengage the handle and the body thereby allowing the handle to change a rotary position relative to the body.

2. An indexable tool comprising;

a handle having a first prong formed with a first splined orifice and a second prong formed with a second splined orifice;

an indexable body having a third splined orifice aligned with the first and second splined orifices;

a splined coupling arrangement rotatably joining and selectively locking and unlocking the handle and the indexable body together, the coupling arrangement including:

a push button disposed within the first, second and third splined orifices for slidable movement relative thereto;

at least a first serrated insert and a second serrated insert, the first serrated insert being positioned on the push button;

the second serrated insert being positioned on the push button and engageable against the first serrated insert;

the first and second serrated inserts having external splines variously engaged with the first, second and third splined orifices upon slidable movement of the push button;

a retainer disposed within the second and third splined orifices for slidable movement relative thereto, the retainer being constantly engaged with the second serrated insert and fixedly coupled to the push button by a fastener threaded axially thereof;

a cap screw threaded into the second prong and a spring interposed between the cap and the fastener, wherein, in a locked position, the spring is biased to hold the external splines of the first and second serrated inserts in common engagement with the first, second and third splined orifices to prevent relative rotation between the indexable body and the handle; and wherein, in an unlocked position, the push button is pushed against the bias of the spring to move the external splines of the first and second inserts into exclusive engagement with the third splined orifice of the indexable body, and to move the external splines of the second serrated insert into engagement with the splined orifices of the second prong enabling rotary adjustment of the indexable body relative to the handle about the cylinder.

3. The indexable tool of claim 1, wherein the indexable body is a curved pry bar.

4. The indexable tool of claim 1, wherein the first prong has a counterbore defined by a threaded annular surface that threadably receives the cap.

5. The indexable tool of claim 1, wherein the push button includes a circular planar head, a stepdown neck underlying the head and a cylinder depending from the neck.

6. The indexable tool of claim 1, wherein the first serrated insert and the second serrated insert have different heights.

7. The indexable tool of claim 1, wherein the first and second serrated inserts have longitudinally extending splines that form a continuous splined formation along the combined length of the inserts.

8. The indexable tool of claim 5, wherein the retainer has a circular planar flange and a cylinder.

9. The indexable tool of claim 8, wherein the retainer cylinder fits within a bore of the push button, and the retainer flange overlies an end of the push button cylinder and an end surface of the second serrated insert.

10. The indexable tool of claim 1, wherein a fastener is used to hold the push button, the first and second serrated inserts and the retainer together.

11. A splined coupling arrangement for rotatably joining and selectively locking and unlocking a handle and a body of an indexable tool, the splined coupling arrangement comprising:

a push button having a push button cylinder with a threaded hole that extends longitudinally through the push button cylinder and opens into a push button bore formed in a lower portion thereof;

a splined cylinder arrangement having a longitudinal bore slidably received on the push button cylinder, the splined cylinder arrangement being defined by a first cylindrical serrated insert positioned on the push button, and a second cylindrical serrated insert positioned on the push button and engageable with the first serrated insert; and a retainer having a retainer flange attached to a retainer cylinder and a retainer bore formed longitudinally through the retainer flange and the retainer cylinder such that the retainer cylinder fits within the push button bore and the retainer flange overlies an end of the push button cylinder and an end surface of the second serrated insert; and a fastener placed through the retainer bore and threaded into the threaded hole of the push button to fixedly hold the push button, the first and second serrated inserts and the retainer together as a unit.

* * * * *